United States Patent [19]

Taniguchi et al.

[11] Patent Number: 4,828,009

[45] Date of Patent: May 9, 1989

[54] METHOD OF MANUFACTURING A COMPLEX BODY OF SINTERED CERAMIC MATERIAL AND METAL

[75] Inventors: Masato Taniguchi; Yoshinori Narita, both of Aichi, Japan

[73] Assignee: NGK Spark Plug Co., Ltd., Aichi, Japan

[21] Appl. No.: 73,173

[22] Filed: Jul. 14, 1987

[30] Foreign Application Priority Data

Jul. 21, 1986 [JP] Japan ..... 61-171458

[51] Int. Cl.[4] ..... B22D 19/08

[52] U.S. Cl. ..... 164/98; 164/410

[58] Field of Search ..... 164/98, 100, 305, 410; 264/267

[56] References Cited

FOREIGN PATENT DOCUMENTS 59-232978 12/1984 Japan ..... 164/98

*Primary Examiner*—Kuang Y. Lin

*Attorney, Agent, or Firm*—Finnegan, Henderson, Farabow, Garrett, & Dunner

[57] ABSTRACT

A method of forming a complex body of a sintered ceramic material and a metal. A through-hole is provided in the sintered ceramic material before it is cast-embedded in the metal. The through-hole provides for the release of gas to prevent the formation of a cavity between the sintered ceramic material and the metal.

6 Claims, 1 Drawing Sheet

METHOD OF MANUFACTURING A COMPLEX BODY OF SINTERED CERAMIC MATERIAL AND METAL

BACKGROUND OF THE INVENTION

1. Field of the Invention

The present invention relates to a method of manufacturing a complex body of a sintered ceramic material and a metal.

2. Description of the Prior Art

Although ceramic materials have relatively a high compressive strength, they have a low tensile strength and impact resistance. To compensate for these weaknesses, the combination of a ceramic material with a metal has recently been studied. Shrink fitting and cast-embedding are well known methods of forming such a combination.

Although shrink fitting is a simple means of forming this combination, it has disadvantages because the shapes of ceramic material capable of being shrink fitted are quite limited and stress will act on the shrink fitted combination only in a fixed direction. For these reasons, the types and uses of products formed by shrink fitting are limited.

In contrast with the above, the cast-embedding method has advantages because ceramic material is strong against compressive stress and the cast-embedding method can be used to form a product of complicated shape. However, the cast-embedding method has a problem because it results in a cavity being formed between the ceramic material and the metal, thus rendering the casting of the metal on the ceramic material imperfect. This cavity formation is caused by a number of factors such as the low wettability of the ceramic material by the molten metal, gas in the molten metal, and moisture in the ceramic material if it is porous. A stress differential arises between a product portion which has a cavity between the ceramic material and the metal and another product portion where the ceramic material and the metal are in contact with each other. As a result, the ceramic material undergoes a shear fracture. To prevent the formation of the cavity, conventional measures such as preheating the ceramic material and coating the surface of the ceramic material have been taken. However, these measures are not completely effective and increase the cost of production.

SUMMARY OF THE INVENTION

An object of the present invention is to eliminate the above-mentioned problems in the prior art.

Accordingly, it is an object of the present invention to provide a method of cast-embedding a sintered ceramic material in a metal without forming a cavity between the ceramic material and the metal.

In order to obtain the above-mentioned object, a through-hole for the release of gas is provided in the sintered ceramic material before the material is cast-embedded in the metal. The through-hole may be provided in the sintered ceramic material either before or after the material is sintered. The through-hole is located in a position where a cavity formed in a preparatory test in which the sintered ceramic material was cast-embedded in the metal without providing the through-hole.

When the sintered ceramic material having the through-hole is cast-embedded in the metal, gas which would normally stay in between the sintered ceramic material and the metal creating a cavity flows out the through-hole into the atmosphere.

If the diameter of the through-hole is less than 0.5 mm, the gas does not flow out well. If the diameter is more than 3 mm, molten metal is likely to flow into the through-hole. Therefore, it is preferable that the diameter of the through-hole is between 0.5 mm and 3 mm. A gas permeable heat-resistant material may be used to fill the through-hole to prevent molten metal from flowing into the hole. The likelihood of the molten metal flowing into the through-hole depends on the wetting property of the molten metal to the sintered ceramic material and the viscosity of the molten metal.

Since a cavity is not formed between the sintered ceramic material and the metal in the method of the present invention, the metal and the sintered ceramic material are properly combined with each other and the sintered ceramic material is not as susceptible to fracture.

BRIEF DESCRIPTION OF THE DRAWINGS

FIG. 3 (B) shows a sectional view of a complex body constituting an auxiliary chamber of an internal combustion engine formed by the method which is a first embodiment of the present invention.

DETAILED DESCRIPTION OF THE PREFERRED EMBODIMENTS

Embodiments of the present invention are hereafter described in detail with reference to the accompanying drawings.

Figure 1:
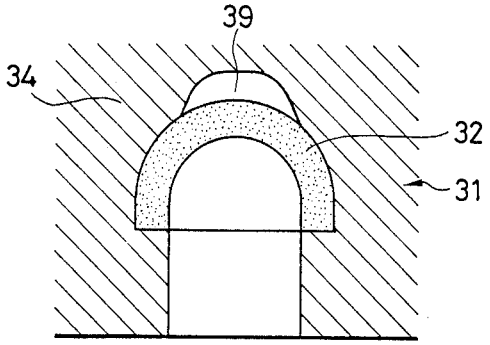
FIG. 1 PRIOR ART
FIGS. 1 and 2 show sectional views of complex bodies consisting of a sintered ceramic material and a metal produced by a conventional prior art manufacturing method.
Figure 2:
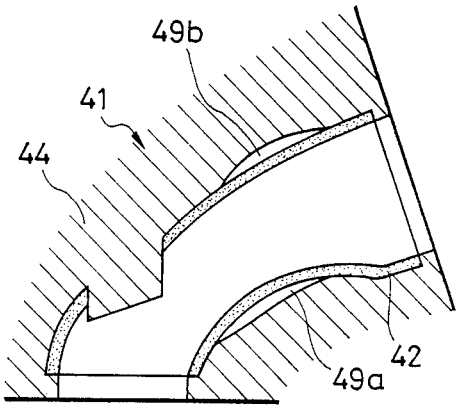
FIG. 2 PRIOR ART

FIGS. 1 and 2 show sectional views of complex bodies 31 and 41 consisting of sintered ceramic materials 32 and 42 and metals 34 and 44. Complex bodies 31 and 41 are produced under the same conditions as the complex bodies 11 and 21 of FIGS. 3 and 4 except that through-holes were not provided in the sintered ceramic materials 32 and 42. As a result, cavities 39, 49*a*, and 49*b* formed between the sintered ceramic materials 32 and 42 and the metals 34 and 44 of the complex bodies 31 and 41.

Figure 3A:
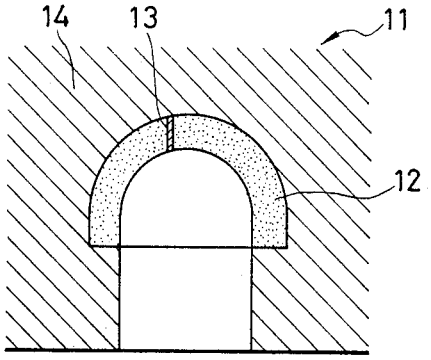
FIG. 3 (A) shows a sectional view of a complex body consisting of a sintered ceramic material and a metal produced by a manufacturing method which is a first embodiment of the present invention.
Figure 3B:
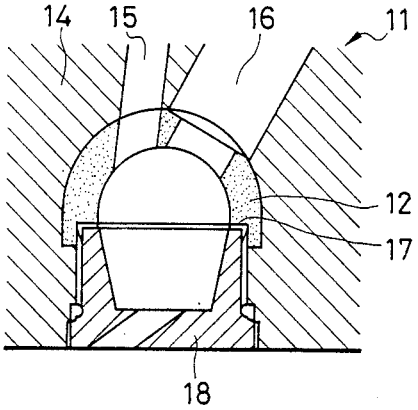

FIG. 3 (A) shows a sectional view of a complex body 11 consisting of a sintered ceramic material 12 and a metal 14 produced by a manufacturing method which is a first embodiment of the present invention. The sintered ceramic material 12 was a hollow hemispherical piece made primarily of aluminum titanate having an outside diameter of 30 mm, a height of 25 mm, and a thickness of 3 mm. A through-hole 13 having a diameter of 1 mm was provided in the sintered ceramic material 12 near the center of the top thereof. The metal 14 was an aluminum alloy (AC-4B) in which the sintered ceramic material 12 was cast-embedded as a core and remained fitted in the internal opening of the sintered ceramic material 12 having the through-hole 13. After the cast-embedding was performed, the core was removed. The complex body 11 was thus produced without a cavity forming between the sintered ceramic material 12 and the metal 14. As a result, the sintered ceramic material 12 has a reduced tendency to undergo shear fracture.

FIG. 3 (B) shows a sectional view of the complex body 11 comprising an auxiliary chamber of an internal combustion engine. A glow plug hole 15 and a nozzle hole 16 are provided in the sintered ceramic material 12 and the metal 14 for the auxiliary chamber by drilling. A plug 18 made of $Si_3N_4$ was fitted together with an interposed gasket 17 in the opening of the sintered ceramic material 12 to complete the auxiliary chamber. If a hole such as the glow plug hole 15 or the nozzle hole 16 is drilled in the same position as the through-hole was located, the through-hole preferably can be eliminated from the finished complex body 11.

Figure 4:
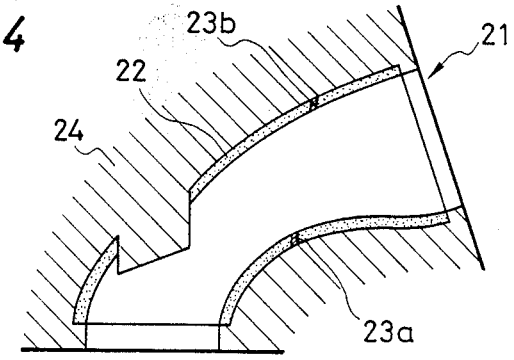
FIG. 4 shows a sectional view of a complex body consisting of a sintered ceramic material and a metal produced in a manufacturing method which is a second embodiment of the present invention.

FIG. 4 shows a sectional view of a complex body 21 consisting of a sintered ceramic material 22 and a metal 24 produced by a manufacturing method which is a second embodiment of the present invention. The sintered ceramic material 22 was made primarily of aluminum titanate and shaped as the port liner of an internal combustion engine. Through-holes 23*a* and 23*b*, each having a diameter of 0.8 mm, were provided in the inner and outer curved portions of the sintered ceramic material 22. The metal 24 was an aluminum alloy (AC-4B) in which the sintered ceramic material 22 was cast-embedded. After the cast-embedding was performed, a core was removed. The complex body 21 was thus produced without a cavity forming between the sintered ceramic material 22 and the metal 24. As a result, the sintered ceramic material 22 will not as readily undergo shear fracture.

Having described preferred embodiments of the present invention, it is understood that variation and modification thereof will become apparent to one skilled in the art, and, as such, these will fall within the scope of the appended claims.

What is claimed is:

1. A method of forming a complex body of a sintered ceramic material and a metal, comprising:

providing a through-hole in the sintered ceramic material for the release of gas, said through-hole having a diameter of between 0.5-3 mm; and cast-embedding said sintered ceramic material in the metal.

2. The method of claim 1, wherein the sintered ceramic material is primarily aluminum titanate.

3. The method of claim 1, wherein a gas permeable heat resistant material is disposed in the through-hole prior to cast-embedding.

4. A method of forming a complex body of a sintered ceramic material and a metal, comprising:

providing a through-hole in the sintered ceramic material for the release of gas;

cast-embedding the sintered ceramic material in the metal; and providing a second hole in the sintered ceramic material and the metal, said second hole being larger than the through-hole and being provided at the same location in the sintered ceramic material as the through-hole.

5. The method of claim 4, wherein the complex body formed is an auxiliary chamber of an internal combustion engine and the second larger hole is a glow plug hole.

6. The method of claim 4, wherein the complex body formed is an auxiliary chamber of an internal combustion engine and the second larger hole is a nozzle hole.

* * * * *